US011118339B2

(12) United States Patent
Bansal et al.

(10) Patent No.: US 11,118,339 B2
(45) Date of Patent: Sep. 14, 2021

(54) SYSTEM FOR COLLECTING AND STORING URINE

(71) Applicants: Anvita Bansal, Pewaukee, WI (US); Anay Bansal, Pewaukee, WI (US); Hannah Dassow, Pewaukee, WI (US); Ethan Dassow, Pewaukee, WI (US); Rylee Wessley, Sussex, WI (US); Autumn Treml, Sussex, WI (US); Mathew Chu, Sussex, WI (US); Delaney M. Nevermann, Sussex, WI (US); Tierney R. Nevermann, Sussex, WI (US); Gaurav Saluja, Sussex, WI (US); Aanya Ranasaria, Menomonee Falls, WI (US)

(72) Inventors: Anvita Bansal, Pewaukee, WI (US); Anay Bansal, Pewaukee, WI (US); Hannah Dassow, Pewaukee, WI (US); Ethan Dassow, Pewaukee, WI (US); Rylee Wessley, Sussex, WI (US); Autumn Treml, Sussex, WI (US); Mathew Chu, Sussex, WI (US); Delaney M. Nevermann, Sussex, WI (US); Tierney R. Nevermann, Sussex, WI (US); Gaurav Saluja, Sussex, WI (US); Aanya Ranasaria, Menomonee Falls, WI (US)

( * ) Notice: Subject to any disclaimer, the term of this patent is extended or adjusted under 35 U.S.C. 154(b) by 0 days.

(21) Appl. No.: 16/414,924

(22) Filed: May 17, 2019

(65) Prior Publication Data

US 2019/0352892 A1 Nov. 21, 2019

Related U.S. Application Data

(60) Provisional application No. 62/672,664, filed on May 17, 2018.

(51) Int. Cl.
*E03D 11/13* (2006.01)
*E03B 1/04* (2006.01)
(Continued)

(52) U.S. Cl.
CPC ..... *E03D 11/17* (2013.01); *E03B 1/042* (2013.01); *E03D 9/00* (2013.01); *E03D 11/13* (2013.01)

(58) Field of Classification Search
CPC . E03D 11/13; E03D 11/17; E03D 9/00; E03B 1/04–2001/045; E03B 1/042;
(Continued)

(56) References Cited

U.S. PATENT DOCUMENTS 904,293 A * 11/1908 Allen ..... A47K 11/02 4/463
1,002,508 A * 9/1911 Faust ..... E03D 11/025 4/341
(Continued)

OTHER PUBLICATIONS

Brands et al., "Urine Diversion and Reuse," A Report by the Rich Earth Institute, Brattleboro, Vermont, Mar. 2018, 21 pages.
(Continued)

*Primary Examiner* — Patrick M. Buechner
(74) *Attorney, Agent, or Firm* — Michael Best & Friedrich LLP

(57) ABSTRACT

A system for collecting and storing urine includes a toilet with a bowl and a tank. The bowl includes a wall dividing the bowl into a first region configured to receive liquid waste and a second region configured to receive solid waste. The system also includes a first line in fluid communication with the first region to transfer the liquid waste from the first region, and a second line in fluid communication with the second region to transfer solid waste from the second region. A storage tank is coupled to the first line such that the storage
(Continued)

tank is configured to receive the liquid waste from the first region via the first line.

20 Claims, 4 Drawing Sheets

(51) Int. Cl.
*E03D 11/17* (2006.01)
*E03D 9/00* (2006.01)

(58) Field of Classification Search
CPC ..... E03B 1/041; E03B 1/044; B60R 15/00; B60R 15/02; B60R 15/04
USPC ..... 4/321–323, 340–342
See application file for complete search history.

(56) References Cited

U.S. PATENT DOCUMENTS 1,056,361 A * 3/1913 Podmore ..... E03D 11/025 4/341
3,086,217 A * 4/1963 Barlow ..... E03D 1/286 4/367
3,336,602 A * 8/1967 Kubit ..... E03D 1/26 4/341
3,505,690 A * 4/1970 Lockwood ..... E03D 5/016 4/317
3,824,632 A * 7/1974 Bach ..... E03D 5/016 4/318
4,052,758 A * 10/1977 Arena ..... E03D 5/014 4/320
4,112,972 A * 9/1978 Lajeuness ..... E02B 13/00 137/236.1
4,162,218 A * 7/1979 McCormick ..... E03B 1/044 210/104
4,197,598 A * 4/1980 Lemmon ..... E03D 1/142 4/326
4,228,006 A * 10/1980 Hanna ..... C02F 3/1242 210/167.3
4,242,765 A * 1/1981 Russell ..... E03F 5/101 4/321
4,347,142 A * 8/1982 Albertassi ..... C02F 1/76 210/173
5,050,248 A * 9/1991 Olivero ..... E03D 1/003 4/341
5,192,426 A * 3/1993 DeCoster ..... E03B 1/04 210/117
5,288,412 A * 2/1994 Voorhees ..... C02F 1/325 137/561 A
5,301,374 A * 4/1994 Smiley ..... E03D 11/025 4/341
5,452,956 A * 9/1995 Gilliam ..... E03B 1/04 366/348
5,548,850 A * 8/1996 Geeham ..... E03D 1/145 4/249
5,730,179 A * 3/1998 Taylor ..... E04D 13/08 137/357
6,061,844 A * 5/2000 Barton ..... E03D 1/145 4/340
6,485,647 B1 * 11/2002 Potts ..... C02F 3/288 210/616
7,360,259 B2 * 4/2008 Chan ..... E03D 5/014 4/300.3
8,191,307 B2 * 6/2012 Donoghue ..... A01G 25/16 47/48.5
2003/0070985 A1 * 4/2003 Potts ..... E03F 1/002 210/616
2004/0168992 A1 * 9/2004 Ben-Amotz ..... E03B 1/04 210/805
2011/0004991 A1 * 1/2011 Tai ..... E03D 9/05 4/420
2011/0113541 A1 * 5/2011 Tillman ..... E03D 11/025 4/341
2015/0342576 A1 * 12/2015 Hall ..... A61B 10/007 600/573
2016/0257586 A1 * 9/2016 Shaamsundarr ..... C02F 3/28
2017/0306601 A1 * 10/2017 Harris ..... E03D 5/01
2019/0010689 A1 * 1/2019 Hall ..... E03D 11/13
2019/0384328 A1 * 12/2019 Vennam ..... G05D 7/0629
2020/0299946 A1 * 9/2020 Lee ..... E03F 1/006

OTHER PUBLICATIONS

Noe-Hays et al., "Urine Diversion for Nutrient Recovery and Micropollutant Management: Results from a Regional Urine Recycling Program," 2015, 10 pages.

* cited by examiner

SYSTEM FOR COLLECTING AND STORING URINE

CROSS-REFERENCE TO RELATED APPLICATIONS

This application claims priority to U.S. Provisional Patent Application No. 62/672,664 filed on May 17, 2018, the entire content of which is incorporated herein by reference.

FIELD OF THE INVENTION

The present disclosure relates to systems for collecting and storing urine, and particularly to such systems that collect urine separately from solid waste.

BACKGROUND

Typically, when urine is flushed away, it travels to a water treatment facility for cleaning and eventual discharge into a nearby body of water. There, various elements (e.g., nitrogen, potassium, and phosphorus) leftover in the treated urine can cause hypoxia in the surrounding water, killing marine life in a so called dead zone. These elements are difficult and costly to extract from the urine in a water treatment facility. However, these same elements are useful and effective as fertilizer for many types of plants.

SUMMARY

The present disclosure provides, in one aspect, a system for collecting and storing urine. The system includes a toilet with a bowl and a tank. The bowl includes a wall dividing the bowl into a first region configured to receive liquid waste and a second region configured to receive solid waste. The system also includes a first line in fluid communication with the first region to transfer the liquid waste from the first region, and a second line in fluid communication with the second region to transfer solid waste from the second region. A storage tank is coupled to the first line such that the storage tank is configured to receive the liquid waste from the first region via the first line.

The present disclosure provides, in another aspect, a toilet including a base with a bowl, a seat coupled to the base, a wall extending across an interior of the bowl to divide the bowl into a first region configured to receive liquid waste and a second region configured to receive solid waste, a first outlet in fluid communication with the first region, a first trap extending from the first outlet, a second outlet in fluid communication with the second region, and a second trap extending from the second outlet. The first region and the second region are each disposed below the seat.

The present disclosure provides, in another aspect, a system for collecting and storing urine. The system includes a toilet with a base including a bowl, a seat coupled to the base, a wall extending across an interior of the bowl to divide the bowl into a first region configured to receive liquid waste and a second region configured to receive solid waste, a first outlet in fluid communication with the first region, and a second outlet in fluid communication with the second region. The system further includes a first line coupled to the first outlet to transfer the liquid waste from the first region, a second line coupled to the second outlet to transfer solid waste from the second region, a storage tank coupled to the first line such that the storage tank is configured to receive the liquid waste from the first region, and an access point in fluid communication with the storage tank via a discharge line. The liquid waste is dispensable from the storage tank at the access point.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

DETAILED DESCRIPTION

Figure 1:
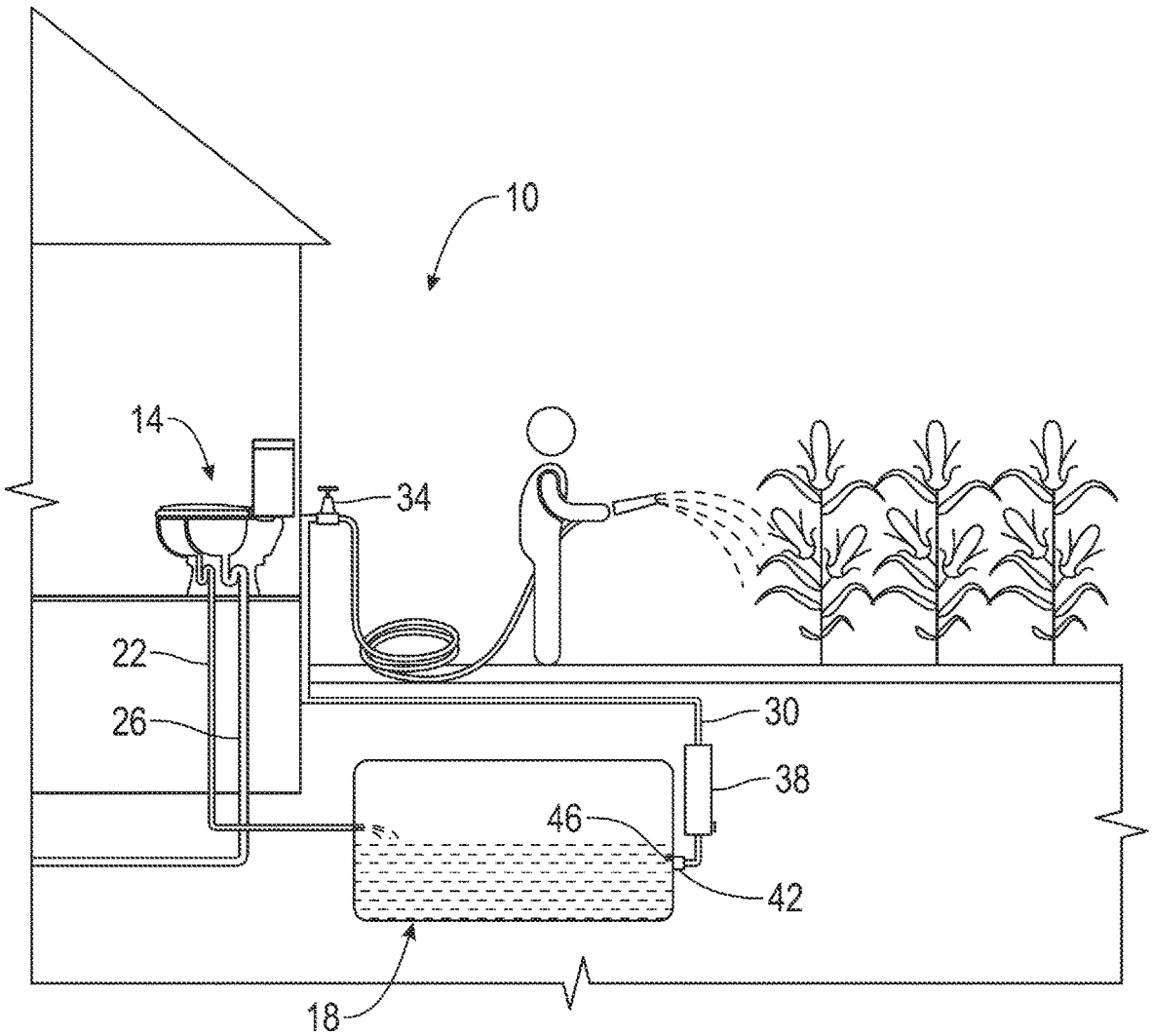
FIG. 1 illustrates a system for collecting and storing urine according to one embodiment of the disclosure.

FIG. 1 illustrates a system 10 for collecting and storing urine according to an embodiment of the disclosure. The system 10 includes a toilet 14 and a storage tank 18. The toilet 14 may be located within a house or other dwelling, a public restroom, or a commercial building, for example. The toilet 14 is fluidly coupled to the storage tank 18 via a first line 22 and fluidly coupled to an external waste handling system (e.g., a septic tank or a municipal sewer system; not shown) via a second line 26. The storage tank 18 may be located either above ground or below ground.

The system 10 further includes a discharge line 30 fluidly coupled to the storage tank 18. The discharge line 30 leads to an access point 34, which includes a hose bib in the illustrated embodiment. Urine solution stored within the storage tank 18 may be drawn out of the tank 18 at the access point 34 for use as a fertilizer. A pump 38 is provided to transfer urine through the discharge line 30 to the access point 34. The pump 38 may be an electrically-powered pump, a gas-powered pump, a manually-operated pump, or any other type of pump. In other embodiments, the access point 34 may receive urine solution from the storage tank 18 under the influence of gravity, without requiring a pump. In such embodiments, the access point 34 is positioned at a level generally below the storage tank 18.

With continued reference to FIG. 1, a replaceable filter 42 is disposed in the discharge line 30 between an outlet 46 of the storage tank 18 and the pump 38. In other embodiments, the filter 42 may be located between the pump 38 and the access point 34. In yet other embodiments, the filter 42 may be incorporated into the access point 34. The filter 42 may include a particulate filter and/or an odor-absorbing element such as biochar or other carbon-based material.

Figure 2:
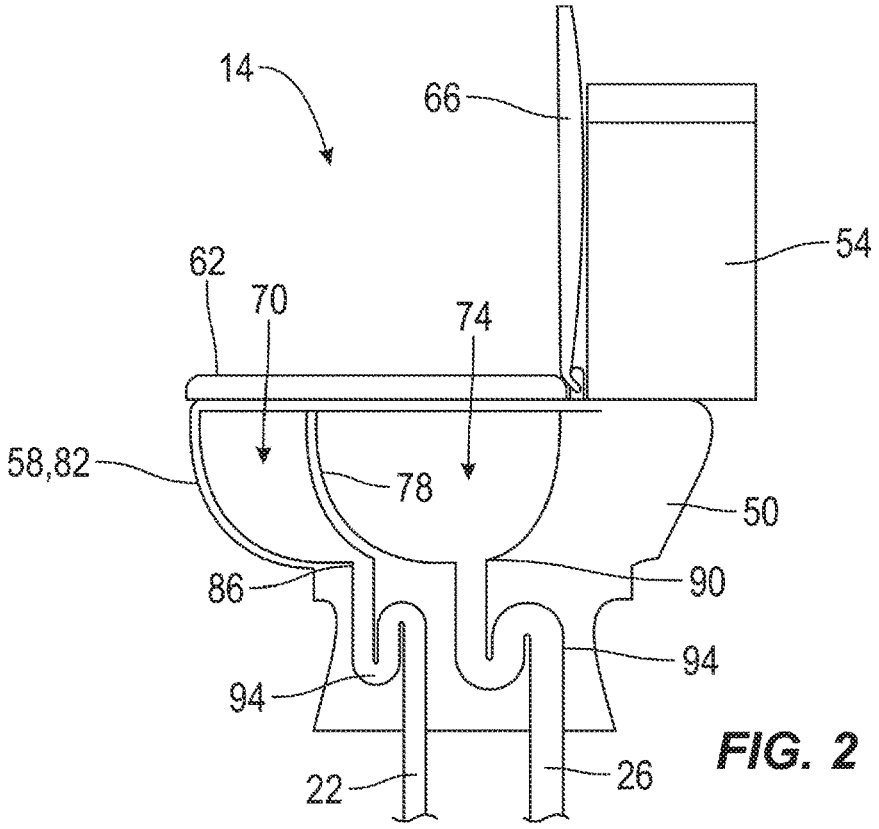
FIG. 2 is a cross-sectional view of a toilet of the system of FIG. 1.

With reference to FIG. 2, the toilet 14 includes a base 50 and a tank 54 coupled to the base 50. In some embodiments, the base 50 and the tank 54 may be separate components coupled together via fasteners. Alternatively, the base 50 and the tank 54 may be integrally formed together as a single unit. The base 50 includes a bowl 58, a seat 62, and a lid 66. The bowl 58 is partitioned into a first or front region 70 and a second or rear region 74 by a wall 78 extending laterally across an interior of the bowl 58. In the illustrated embodiment, the wall 78 is curved toward the center of the bowl 58, and the wall 78 and a front portion 82 of the bowl 58 have the same or similar curvatures. In other embodiments, the wall 78 may not be curved or may be curved or contoured in other ways. The front region 70 includes a first outlet 86 that is fluidly coupled to the first line 22, and the rear region 74 includes a second outlet 90 that is fluidly coupled to the second line 26. A sewer gas trap 94, such as an S-trap, is positioned fluidly between each of the outlets 86, 90 and the respective lines 22, 26 to inhibit gases and odors from entering the bowl 58 through the outlets 86, 90.

Figure 3:
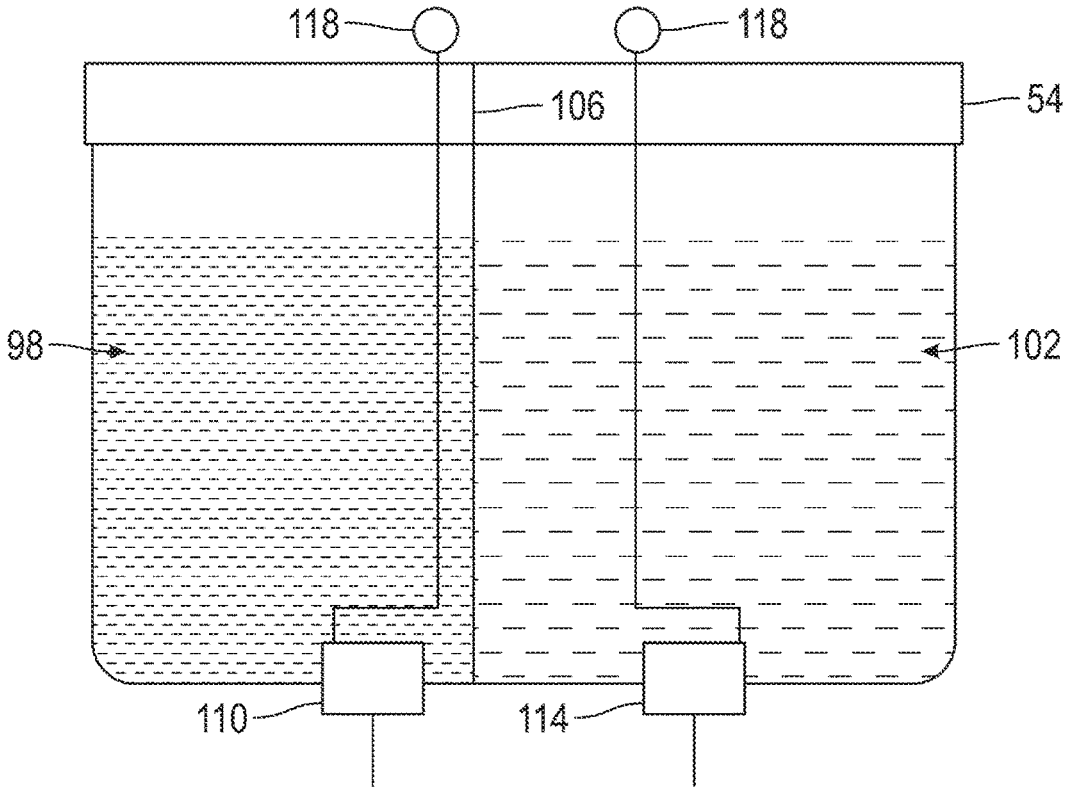
FIG. 3 is a cross-sectional view of a tank of the toilet of FIG. 2.

Referring to FIG. 3, the illustrated tank 54 is partitioned into a first volume 98 and a second volume 102 by a wall 106. Each volume 98, 102 is configured to store water for flushing the toilet 14. The water may be provided to the tank 54 via a water supply (not shown) in any suitable manner. The first volume 98 is fluidly coupled to the front region 70 via a first flush valve 110, and the second volume 102 is fluidly coupled to the rear region 74 via a second flush valve 114. Each of the flush valves 110, 114 includes an associated flushing actuator 118 (e.g., a handle, button, or the like) accessible from the exterior of the tank 54. The flush valves 110, 114 may be any type of toilet flush valve and need not be described in detail. In the illustrated embodiment, the second volume 102 is larger than the first volume 98, and the flush valves 110, 114 are configured such that flushing the front region 70 of the toilet 14 uses less water than flushing the rear region 74 of the toilet 14. In other embodiments, the first and second volumes 98, 102 may be equally sized. In yet other embodiments, the tank 54 may not be partitioned such that the first and second flush valves 110, 114 receive water from a common volume within the tank 54.

Figure 4:
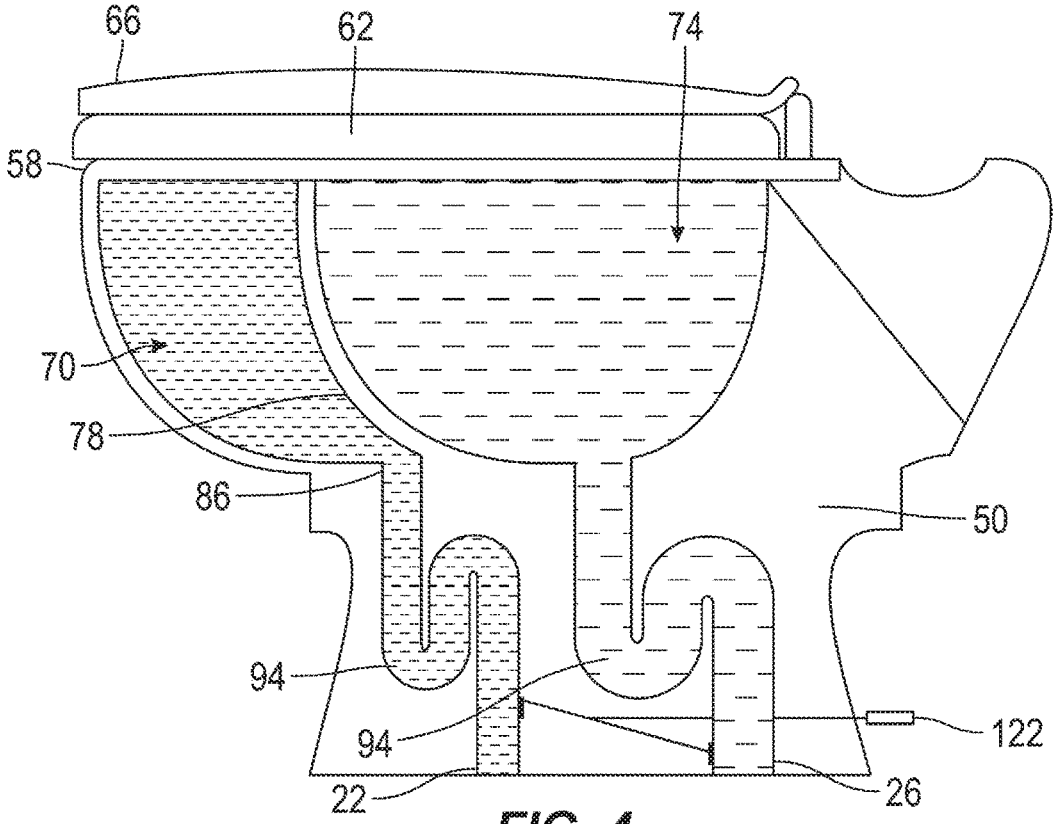
FIG. 4 is a cross-sectional view of a base of the toilet of FIG. 2.

Referring to FIG. 4, the wall 78 in the bowl 58 is positioned such that urine is directed into the front region 70 and solid waste is directed into the rear region 74 when a user is seated on the seat 62. As such, urine and solid waste do not mix, and the toilet 14 keeps the two waste components separated. Urine contained in the front region 70 can then be flushed through the first outlet 86, into the first line 22, and to the storage tank 18 (FIG. 1), while solid waste and toilet paper can be flushed through the second outlet 90, into the second line 26, and to the external waste treatment system. Thus, urine can be conveniently collected without appreciably altering a user's methods of using the toilet 14. In the illustrated embodiment, a diverter valve 122 is provided downstream of the traps 94 (FIG. 4). The diverter valve 122 can be actuated by the user to direct the contents of the front region 70 into the second line 26 if the front region 70 receives solid waste, toilet paper, cleaning products, or any other non-urine substance. In addition, the diverter valve 122 can be actuated in the event the storage tank 18 is at full capacity.

In some embodiments, the system 10 includes a controller (not shown) capable of monitoring the fill level of the storage tank 18 (e.g., via a float sensor, conductivity sensor, or other suitable sensor). In such embodiments, the controller may trigger a visual or audible alarm to indicate to the user that the storage tank 18 is full. The user may then actuate the diverter valve 122 to divert the contents of the first region 70 into the second line 26. In some embodiments, the diverter valve 122 includes an electronic actuator (e.g., a solenoid), and the controller may communicate with the diverter valve 122 to automatically actuate the valve when the storage tank 18 is full.

Figure 5:
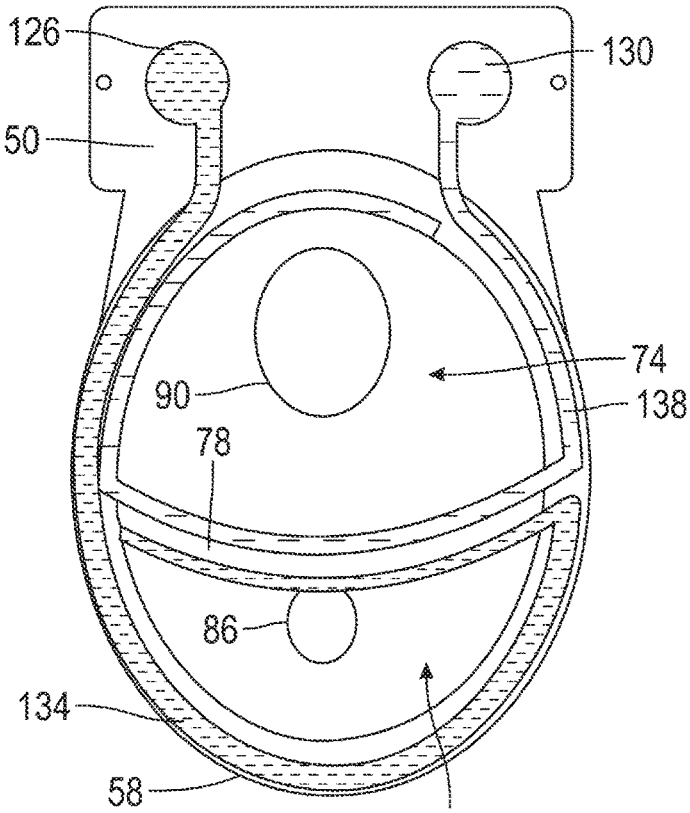
FIG. 5 is a top view of the base of FIG. 4.

With reference to FIGS. 3 and 5, the base 50 of the toilet 14 includes a first inlet 126 fluidly coupled to the first volume 98 of the tank 54 via the first flush valve 110 and a second inlet 130 fluidly coupled to the second volume 102 of the tank 54 via the second flush valve 114. A first flow path 134 extends forward from the first inlet 126, along an inner periphery of the bowl 58, past the wall 78, and around the perimeter of the front region 70. The first flow path 134 may include an internal waterway cast into the rim of the bowl 58. A second flow path 138 separate from the first flow path 134 extends forward from the second inlet 130 along an inner periphery of the bowl 58 opposite the first flow path 134. Upon reaching the wall 78, the second flow path 138 impinges on the wall 78 and flows along the rear side of the wall 78, and then flows along the remaining perimeter of the rear region 74. Thus, the toilet 14 is configured to provide two looping flow paths 134, 138 that effectively move the contents of the front region 70 and the rear region 74 to the respective outlets 86, 90 upon flushing.

Because the front region 70 typically only includes urine, less water is required to flush the front region 70 than the rear region 74. In some embodiments, flushing the front region 70 (e.g., by actuating the first actuator 118) uses about 0.5 gallons of water or less. Flushing the rear region 74 uses about 1.0 gallon of water or less. The toilet 14 thus advantageously consumes significantly less water than a conventional toilet. The amount of water used in flushing the front region 70 can be tuned to dilute the urine to a desirable concentration for use as fertilizer.

In use, the toilet 14 separates and collects urine in the front region 70 and solid waste in the rear region 74. Advantageously, both urine and solid waste can be collected and kept separate at the same time, or urine may be collected separately. The user can then flush the front region 70 and, if necessary, the rear region 74 by actuating the first and second actuators 118, respectively. Water flows from the first volume 98 of the tank 54 through the first flush valve 110 and into the front region 70 to flush the urine through the first outlet 86, and water flows from the second volume 102 of the tank 54 through the second flush valve 114 and into the rear region 74 to flush the solid waste through the second outlet 90. The urine and flush water travel through the first line 22 into the storage tank 18. The flush water may dilute the urine to a particularly suitable concentration for use as fertilizer. The contents of the storage tank 18 can be drawn out through the discharge line 30 and to the access point 34, then applied to plants via a hose, for example. Alternatively, the access point 34 may be used to remove the contents of the storage tank 18 for transfer to another facility (e.g., for pasteurization or conversion into struvite, which can be distributed to farmers for use as fertilizer).

Figure 6:
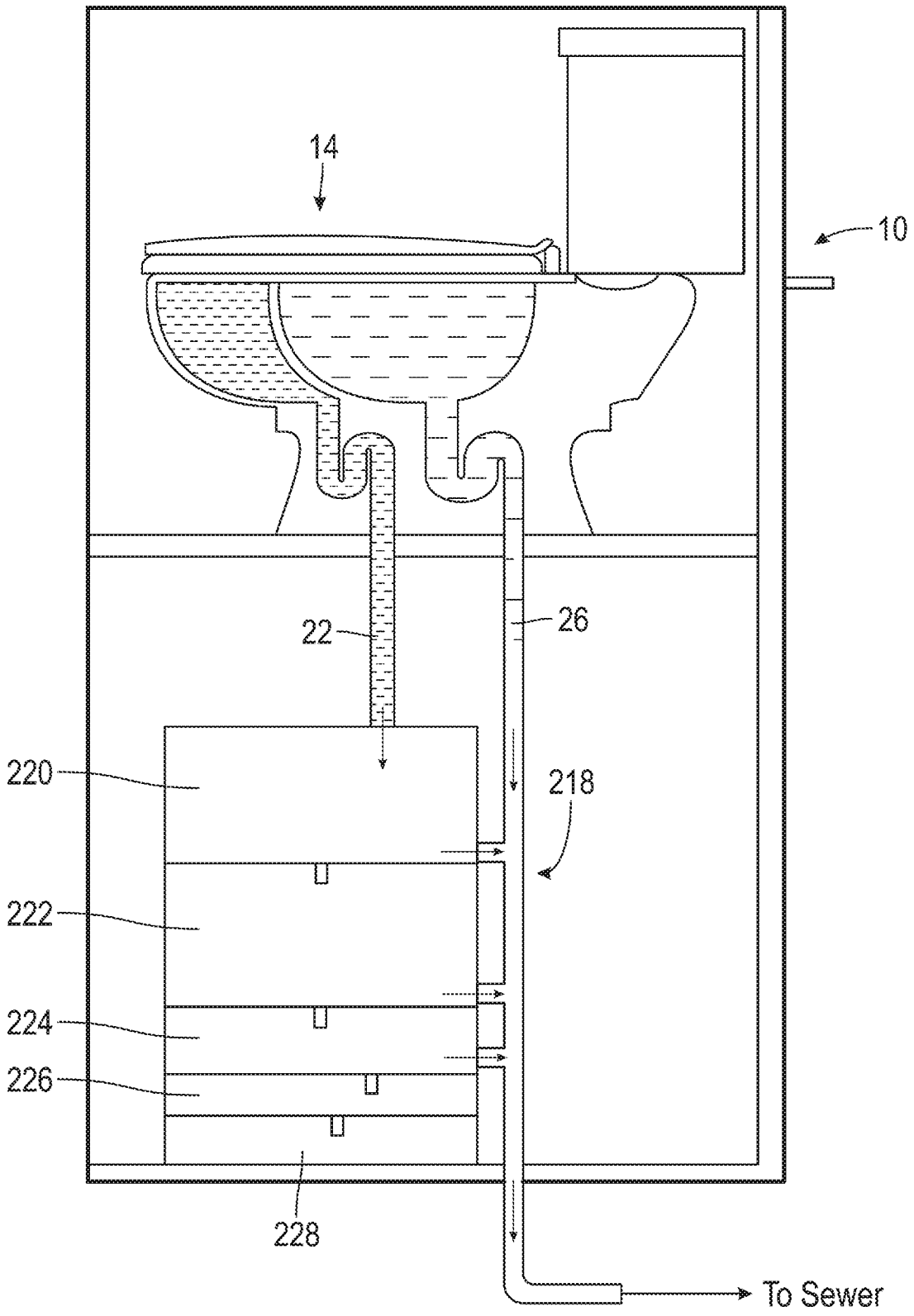
FIG. 6 illustrates a storage tank according to another embodiment that is usable with the system of FIG. 1.

FIG. 6 illustrates a storage tank 218 according to another embodiment and usable with the system 10 of FIG. 1. The storage tank 218 is configured as a struvite reaction chamber configured to convert at least a portion of the collected urine into struvite crystals. Struvite ($NH_4MgPO_4.6H_2O$) is created when magnesium, ammonia and phosphate combine in water in equal molar ratios.

The illustrated storage tank 218 includes five chambers. A first chamber 220 receives diluted urine from the toilet 14. The diluted urine then flows in a controlled manner under the influence of gravity to a second chamber 222. In the second chamber 222, the urine is concentrated and aged until its pH rises (e.g., to a level of about 9) using a quenching agent. The concentrated and aged urine then flows in a controlled manner under the influence of gravity to a third chamber 224. In the third chamber 224, the urine is mixed with diluted Magnesium oxide with the stirring action separating urine into struvite paste and effluent. The third chamber 224 is coupled to the second line 26 such that the effluent can be discharged to the external treatment system. The struvite paste then enters a fourth chamber 226, where it is dehydrated into struvite. The struvite is then transferred to a fifth chamber 228 for storage. The fifth chamber 228 includes an access opening (not shown) to allow the struvite to be collected and to facilitate cleaning and maintaining the storage tank 218.

Thus, the disclosure provides a system for collecting and storing urine. The system includes a toilet that is similar in use and appearance to a conventional toilet, and therefore convenient and intuitive to use. The toilet can separate urine from solid waste, allowing the urine to be collected and stored in a storage tank for use a fertilizer. Because the urine is not sent to an external treatment system, treatment costs and dead zones in bodies of water near the outlet of the external treatment system can be reduced. In addition, the toilet is able to operate more efficiently and use less water than a conventional toilet because urine and solid waste can be flushed separately with different amounts of flush water.

Various features of the invention are set forth in the following claims.

What is claimed is:

1. A system for collecting and storing urine, comprising:
- a toilet including a bowl and a tank, wherein the bowl includes a wall dividing the bowl into a first region configured to receive liquid waste and a second region configured to receive solid waste;
- a first line in fluid communication with the first region to transfer the liquid waste from the first region;
- a second line in fluid communication with the second region to transfer solid waste from the second region;
- a diverter valve configured to selectively direct material from the first line into the second line; and
- a storage tank coupled to the first line such that the storage tank is configured to receive the liquid waste from the first region via the first line.

2. The system of claim 1, wherein the storage tank includes a reaction chamber configured to convert at least a portion of the liquid waste into struvite.

3. The system of claim 1, wherein the first region is farther than the second region from the tank of the toilet.

4. The system of claim 1, wherein the diverter valve is configured to direct the material from the first line into the second line in response to the storage tank reaching a predetermined fill level.

5. The system of claim 1, wherein the toilet further includes:
- a seat coupled to the bowl;
- a first outlet in fluid communication with the first region;
- a first trap extending from the first outlet;
- a second outlet in fluid communication with the second region; and
- a second trap extending from the second outlet,
- wherein the first region and the second region are each disposed below the seat.

6. The system of claim 5, wherein the diverter valve is positioned downstream of the first trap and the second trap.

7. The system of claim 1, further comprising an access point in fluid communication with the storage tank via a discharge line, wherein the liquid waste is dispensable from the storage tank at the access point.

8. The system of claim 7, wherein the access point includes a hose bib.

9. The system of claim 7, further comprising a pump configured to convey the liquid waste from the storage tank to the access point.

10. The system of claim 7, further comprising an odor-absorbing filter positioned along the discharge line.

11. The system of claim 1, wherein the tank of the toilet includes a first volume configured to store water for flushing the contents of the first region into the first line, and wherein the tank of the toilet includes a second volume separate from the first volume and configured to store water for flushing the contents of the second region into the second line.

12. The system of claim 11, wherein the second volume is larger than the first volume.

13. The system of claim 12, wherein the first volume is configured to provide 0.5 gallons of water per flush to the first region, and wherein the second volume is configured to provide 1.0 gallons of water per flush to the second region.

14. The system of claim 13, wherein the bowl includes a first flow path configured to direct the water from the first volume around a perimeter of the first region, and wherein the bowl includes a second flow path configured to direct the water from the second volume around a perimeter of the second region.

15. The system of claim 14, wherein the first flow path extends along a front side of the wall, and wherein the second flow path extends along a rear side of the wall.

16. A system for collecting and storing urine, comprising:
- a toilet including
  - a base including a bowl,
  - a seat coupled to the base,
  - a wall extending across an interior of the bowl to divide the bowl into a first region configured to receive liquid waste and a second region configured to receive solid waste,
  - a first outlet in fluid communication with the first region, and
  - a second outlet in fluid communication with the second region; and
- a first line coupled to the first outlet to transfer the liquid waste from the first region;
- a second line coupled to the second outlet to transfer solid waste from the second region to a municipal sewer system;
- a storage tank coupled to the first line such that the storage tank is configured to receive the liquid waste from the first region; and
- an access point in fluid communication with the storage tank via a discharge line,
- wherein the liquid waste is dispensable from the storage tank at the access point.

17. The system of claim 16, wherein:
- the toilet includes a tank, the tank includes a first volume configured to store water for flushing the contents of the first region into the first line and a second volume separate from the first volume and configured to store water for flushing the contents of the second region into the second line, and the bowl includes a first flow path configured to direct the water from the first volume around a perimeter of the first region and a second flow path configured to direct the water from the second volume around a perimeter of the second region.

18. The system of claim 17, wherein the toilet is configured to provide 0.5 gallons of water per flush to the first region, and wherein the toilet is configured to provide 1.0 gallons of water per flush to the second region.

19. The system of claim 16, wherein the storage tank includes a reaction chamber configured to convert at least a portion of the liquid waste into struvite.

20. The system of claim 19, wherein the reaction chamber includes magnesium oxide.

* * * * *